US007243758B2

(12) United States Patent
Ishino et al.

(10) Patent No.: US 7,243,758 B2
(45) Date of Patent: Jul. 17, 2007

(54) FOOD AND DRINK MANAGING DEVICE IN CIRCULATION TYPE CARRYING PATH

(75) Inventors: Yuichi Ishino, Kanazawa (JP); Minoru Sakurai, Kanazawa (JP)

(73) Assignee: Ishino Seisakusyo Co., Ltd., Kanazawa-shi, Ishikawa (JP)

( * ) Notice: Subject to any disclaimer, the term of this patent is extended or adjusted under 35 U.S.C. 154(b) by 94 days.

(21) Appl. No.: 10/758,788

(22) Filed: Jan. 16, 2004

(65) Prior Publication Data

US 2004/0221723 A1 Nov. 11, 2004

(30) Foreign Application Priority Data

Jan. 18, 2003 (JP) ..... 2003-045148

(51) Int. Cl.
*E04H 3/04* (2006.01)

(52) U.S. Cl. ..... 186/49

(58) Field of Classification Search ..... 198/340, 198/341.01, 341.03, 341.07, 349, 358; 235/377, 235/378, 383, 385; 186/49, 38, 39; 705/15; 99/484, 646 R See application file for complete search history.

(56) References Cited

U.S. PATENT DOCUMENTS

| | | | | |
|---|---|---|---|---|
| 1,330,890 | A * | 2/1920 | Mayne | 186/49 |
| 3,856,135 | A * | 12/1974 | Hayakawa et al. | 198/860.5 |
| 4,349,086 | A * | 9/1982 | Yamada | 186/49 |
| 4,401,189 | A * | 8/1983 | Majewski | 186/68 |
| 5,557,096 | A * | 9/1996 | Watanabe et al. | 235/492 |
| 6,427,806 | B1 * | 8/2002 | Tanaka | 186/49 |
| 6,431,318 | B1 * | 8/2002 | Tanaka | 186/49 |
| 6,554,106 | B1 * | 4/2003 | Tokimoto | 186/49 |
| 6,581,727 | B1 * | 6/2003 | Tokuno | 186/50 |
| 2002/0002493 | A1 * | 1/2002 | Tanaka | 705/15 |
| 2002/0088671 | A1 * | 7/2002 | Tanaka | 186/38 |

FOREIGN PATENT DOCUMENTS

| | | |
|---|---|---|
| JP | 08-238157 | 9/1996 |
| JP | 09-044753 | 2/1997 |
| JP | 2002-017546 | 1/2002 |

* cited by examiner

*Primary Examiner*—Patrick Mackey
*Assistant Examiner*—Mark J. Beauchaine
(74) *Attorney, Agent, or Firm*—Chapman and Cutler LLP

(57) ABSTRACT

A food and drink managing device with a circulation type path allows standardizing while adding food and drink onto the carrying path, simplifying management, holding down cost, and achieving precise identification information reading. The food and drink managing device with a circulation type carrying path has containers with identification information, an identification information reading means provided near said path, a sign part circularly moving as linked with said circulating carrying path, passage detection means for detecting passage of said sign parts, a registering means which recognizes an interval between passing sign parts as one zone, and registers the identification information of the containers read by said reading means, as foods and drinks being supplied, in relation to a zone in which the containers exist, and a container throwing-in prohibited area of a given length provided in the upstream side of the circulating carrying path from a position of the reading means.

7 Claims, 10 Drawing Sheets

Fig.7

(a)

| Zone | ID | Price | Throw-in time |
|---|---|---|---|
| #1 | B-025 | ¥150 | 11:35 |
| #1 | A-115 | ¥100 | 11:38 |
| #1 | D-056 | ¥300 | 11:26 |
| #5 | A-012 | ¥100 | 11:30 |
| #5 | B-007 | ¥150 | 11:33 |

(b)

| Zone | ID | Price | Throw-in time | Picking time |
|---|---|---|---|---|
| #1 | B-025 | ¥150 | 11:35 | 11:39 |
| #2 | B-042 | ¥150 | 11:28 | 11:37 |
| #3 | D-026 | ¥300 | 11:26 | 11:36 |
| #1 | D-058 | ¥300 | 11:19 | 11:35 |
| | | | [illegible] | 11:32 |
| | | | | |
| #2 | A-246 | ¥100 | 11:12 | 11:25 |
| #4 | C-182 | ¥150 | 11:11 | 11:25 |

FOOD AND DRINK MANAGING DEVICE IN CIRCULATION TYPE CARRYING PATH

BACKGROUND OF THE INVENTION (1) Field of the Invention

Present invention relates to a food and drink managing device that manages foods and drinks with a circulation type carrying path that conveys foods and drinks.

(2) Related Art Statement

Heretofore, the circulation carrying type dining counter is widely used, which has the endless circulation type carrying path for conveying foods and drinks along the dining table, such as counter, and conveys the containers, such as the plates with foods and drinks, for example Sushi, on this carrying path, because it enables customer to eat and drink without moving, or cook to prepare foods without moving, and also enables customer to choose and eat the food and drink that they want while sitting.

In the circulation carrying type dining counter as aforesaid, the number and variety of food and drink on the carrying path may decrease because the customer chooses the food and drink conveyed on the carrying path by their favor. Therefore, it is sometimes difficult to supply sufficient services.

Consequently, the supply of food and drink for the reduced food and drink on the carrying path will be important. However, there are problems, such as it is difficult to figure out the number of each variety of food and drink on the carrying path, and supply the sufficient number without excess and deficiency, which requires a lot of workload, and also, it is difficult to standardize and generalize the supply, because it is decided by one's experience what kind of food and drink, and how much, is to be supplied.

In order to solve the above-described problems, a system that standardizes and generalizes the supply and the like by knowing the condition of food and drink on the carrying path, is described in prior patent documents 1 or 2. This system manages the food and drink on the carrying path by providing the individual identification (ID) to the same type of food/drink containers in advance, registering this ID and the classification of food and drink in relation before throwing-in the containers, and detecting the ID through the carrying path. However, in order to manage these foods and drinks on the carrying path precisely in real-time, since the carrying path is relatively long, it is necessary to set many ID reading devices near the carrying path, which causes the problems such as complicating the device and raising the cost.

In these circumstances, an improved food and drink managing system is already suggested in prior patent document 3. This improved food and drink managing system divides numbers of circulating food/drink containers into several zones and manages the throwing-in and taking of food/drink container in each zone. It has the advantages to reduce the cost of whole device and to simplify the management and conduct without loss of real-time quality or increase of conducting charges.

(Prior patent document 1)

Publication of Japanese Patent Application No. H8-238157

(cf. Claims, FIG. 1)

(Prior patent document 2)

Publication of Japanese Patent Application No. H 9-44753

(cf. Claim 1, FIGS. 1-3)

(Prior Patent document 3)

Publication of Japanese Patent Application No. 2003-17546

(cf. Claim 1, FIG. 1)

SUMMARY OF THE INVENTION

However, in the above improved food and drink managing system, there were cases that identification information reading device did not read the ID precisely, because when a person tries to add the food/drink container to circulation carrying path near the identification information reading device, if the food/drink containers exist on the throwing-in area, the added food/drink container will push through those food/drink containers and the food/drink containers which are in the downstream side from the throwing-in area are temporarily running or overlapping with another one.

By thinking over the above condition, the object of present invention is that in standardizing while adding food and drink for the reduced food and drink on carrying path, the food and drink managing device with a circulation type carrying path will be offered, which enables to simplify management and conduct, hold down the cost of whole device, and further achieve the precise identification information reading.

BRIEF DESCRIPTION OF THE DRAWINGS

FIG. 7 (*a*) is a table that shows the organization of Sushi supply data base in food and drink managing device in present invention example.

FIG. 7(*b*) is a table that shows the organization of consumed Sushi data base in food and drink managing device in present invention example.

DESCRIPTION OF CODE

Figure 1:
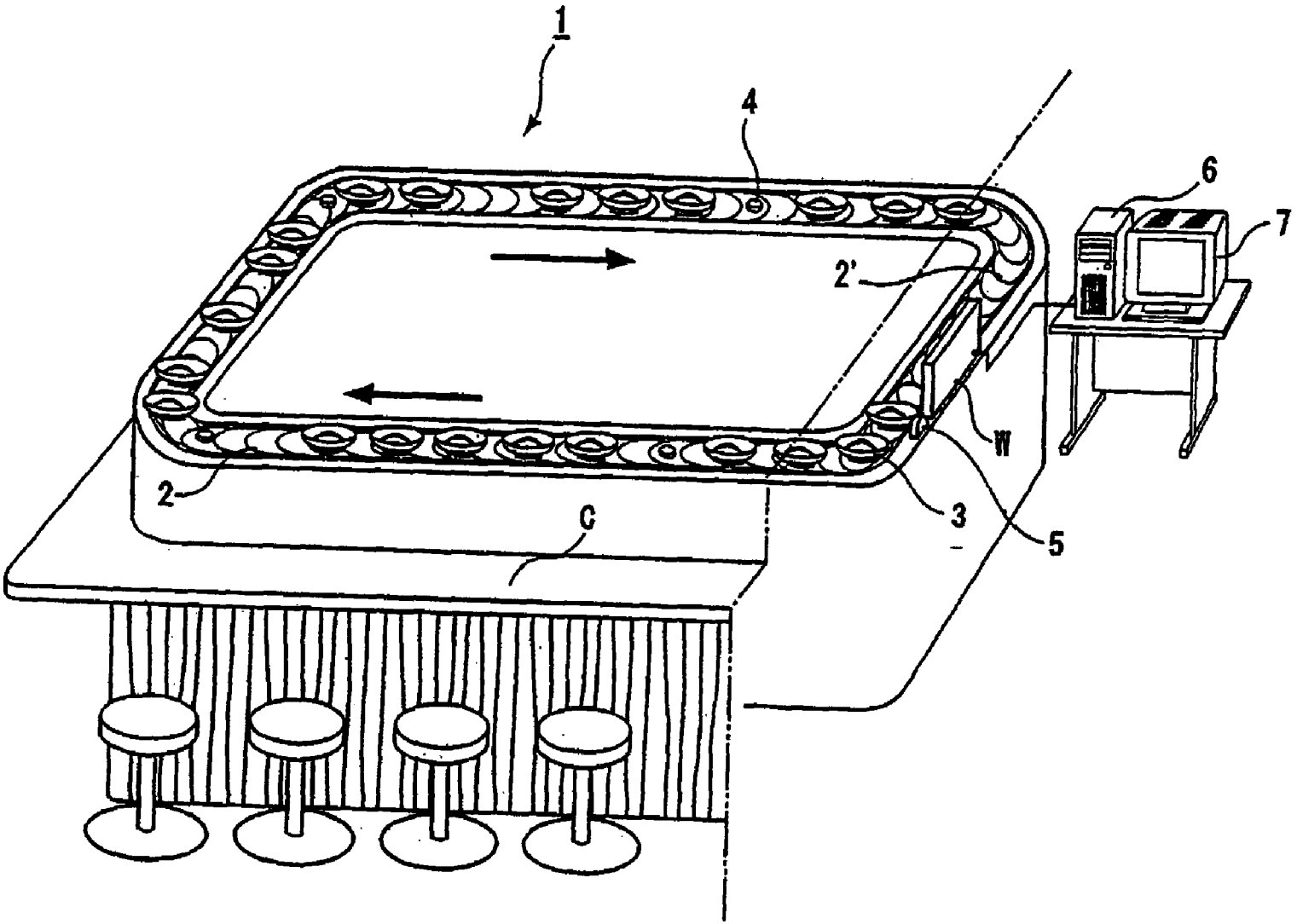
FIG. 1 is a view showing a squinting overview frame format of dining counter which has circulation type carrying path with food and drink managing device of present invention example.

1 Dining counter
2 Carrying path (Flat top chain conveyor)
2' Throwing-in area
3, 3' Sushi plate
4 Sign parts
4' Screw parts
5,5', 5A, 5B Reading unit (identification information reading means, passage detection means)
6 Managing computer (registering means)
7 Display
8 Crescent stat
9 Rotating axis
10 Data bus
11 Central Processing Unit (CPU)
12 RAM
13 Communication interface
14 Display interface
15 Memory device
16 Input interface
17 Real Time Clock (RTC)
18 Reading unit interface
19 Communication device
20, 21 ID tag
22 Tunnel-shaped-cover
30 Bar-code
W, W' Throwing-in protecting wall

DETAILED DESCRIPTION OF THE INVENTION

In order to solve said problems, as present invention, a food and drink managing device with a circulation type carrying path for providing containers carrying foods and drinks to customers by an endless circulating carrying path is characterized by including an identification information reading means for reading identification information on containers, adapted to identify individual containers, and provided near said circulating carrying path, at least one sign part circularly moving as linked with said circulating carrying path, a passage detection means provided near said circulating carrying path to detect passage of said sign parts, a registering means connected to said identification information reading means and said passage detection means, which recognizes an interval between the passing sign parts as one zone, and registers the identification information of the containers read by said identification information reading means, as foods and drinks being supplied, in relation to a zone in which the containers exist, and a container throwing-in prohibited area of a given length provided in the upstream side of the circulating carrying path from a position of the identification information reading means.

In this way, the present invention reduces the number of said identification information reading means, for example, to one, said registering means will register the identification information of the container in relation to the zone in which the containers exist, and if said sign part in the downstream side of said zone passes and the identification information registered as food and drink being supplied in relation to said zone is not be detected, it can be precisely judged that said supplying food and drink is removed by customer, and not only will it reduce the burden of conduct by simplifying these judging conduct, but also, for example by placing with adding properly said sign parts, alike the case that a number of the prior identification information means are placed, it enables to get the quality of real-time managing information, and in consequence it will prevent loss of real-time quality of management, without increasing the burden of conduct in managing conduct, and will hold down the cost of whole device. Furthermore, because the container throwing-in prohibited area of a prescribed length is provided in the upstream side of the circulating carrying path from a position of the identification information reading means, in throwing-in moment of container, the containers that are in downstream side from the throwing-in area are not temporarily running or overlapping with another one in the place of identification information reading means, and so, the reading of the identification information will be able to be accurately performed.

As present invention, it is preferable that in the food and drink managing device with a circulation type carrying path, said container throwing-in prohibited area comprises a throwing-in protecting wall along the circulating carrying path.

In this way, the throwing-in protecting wall will prevent the throwing-in even if by mistake one tried to throw-in the container near the place that has identification information reading means.

As present invention, it is preferable that in the food and drink managing device with a circulation type carrying path, said container throwing-in prohibited area comprises a tunnel-shaped-cover that covers the containers.

In this way, the throwing-in is prevented by the tunnel-shaped-cover that covers the containers, and identification information can be precisely read by reading means.

As present invention, it is preferable that in the food and drink managing device with a circulation type carrying path, said identification information reading means is positioned inside said tunnel-shaped-cover, and further comprising an electromagnet shield on said tunnel-shaped-cover.

In this way, there is no need to worry about the disruption of reading of identification information by reading means with the interference of other electric wave.

As present invention, it is preferable that in the food and drink managing device with a circulation type carrying path, a plurality of said sign parts are positioned at almost regular intervals on said circulating carrying path.

In this way, not only will the maximum of foods and drinks that exist in each zone will be almost identical, but also, because the conveying speed of circulating carrying path is almost constant in general, it is possible to make the transiting interval of said sign parts to be almost identical and, the managing conduct can be operated efficiently.

As present invention, it is preferable that in the food and drink managing device with a circulation type carrying path, said sign part has sign identification information readable by said identification information reading means, and said identification information reading means is combined with said passage detection means.

In this way, because sign identification information reading means is combined with the passage detection means, the cost of whole device will be low.

As present invention, it is preferable that in the food and drink managing device with a circulation type carrying path, said registering means, when detecting new identification information from said identification information reading means, registers the identification information with related time information in that moment.

In this way, by comparing said time information and present time, the estimated elapsed time of that food and drink on circulating carrying path can be known. For example, management of the freshness of food and drink by using the elapsed time can be operated.

As present invention, it is preferable that in the food and drink managing device with a circulation type carrying path, said registering means, when said sign part in a downstream side of said zone passes and the identification information registered as food and drink being supplied in relation to the zone is not be detected, changes the record of identification information to a removed food and drink, and registers time information of said record change in relation to the identification information, and further, holds said registration for a specified time.

In this way, the specified time for holding said registration, for example, is set little shorter than the time until after eating and drinking, containers are collected, washed and used again, 15 minutes as an example. Even in the case when customer removed the food and drink from carrying path and returned the food and drink to the different zone, when identification (ID) of the container that has food and drink was read again, if the same identification information as one of said removed food and drink exists, it can be judged that the food and drink are returned to the carrying path by customer, and the mismatching of management information by the returning of these food and drink will be prevented.

As present invention, it is preferable that in the food and drink managing device with a circulation type carrying path, said registering means changes said specified time for said registration of the removed food and drink.

In this way, like aforesaid, the time until after eating and drinking, containers are collected, washed and used again, is generally different in each restaurant, present invention enables to set up those time in accordance with each restaurant.

As present invention, it is preferable that in the food and drink managing device with a circulation type carrying path, said identification information reading means reads the identification information given on said container without contacting the container.

In this way, present invention eliminates the problems during reading such as attrition of food and drink container.

As present invention, it is preferable that in the food and drink managing device with a circulation type carrying path, for providing the identification information to said container said container has an identification tag, which sends identification as stored identification information by wireless means.

In this way, ID reading will be done by wireless means, and stable reading will be conducted without the reading error by the food and drink location, dirt or the like.

As present invention, it is preferable that in the food and drink managing device with a circulation type carrying path, said identification information includes price information of foods and drinks.

In this way, present invention enables to manage the price information of foods and drinks supplied on carrying path at the same time.

As present invention, it is preferable that in the food and drink managing device with a circulation type carrying path, said identification information reading means is provided adjacent to a throwing-in area of the circulating carrying path and in downstream from the throwing-in area.

In this way, the error between the actual time of throwing-in and the time registered by the identification information reading means with new detection will lessen.

Figure 2:
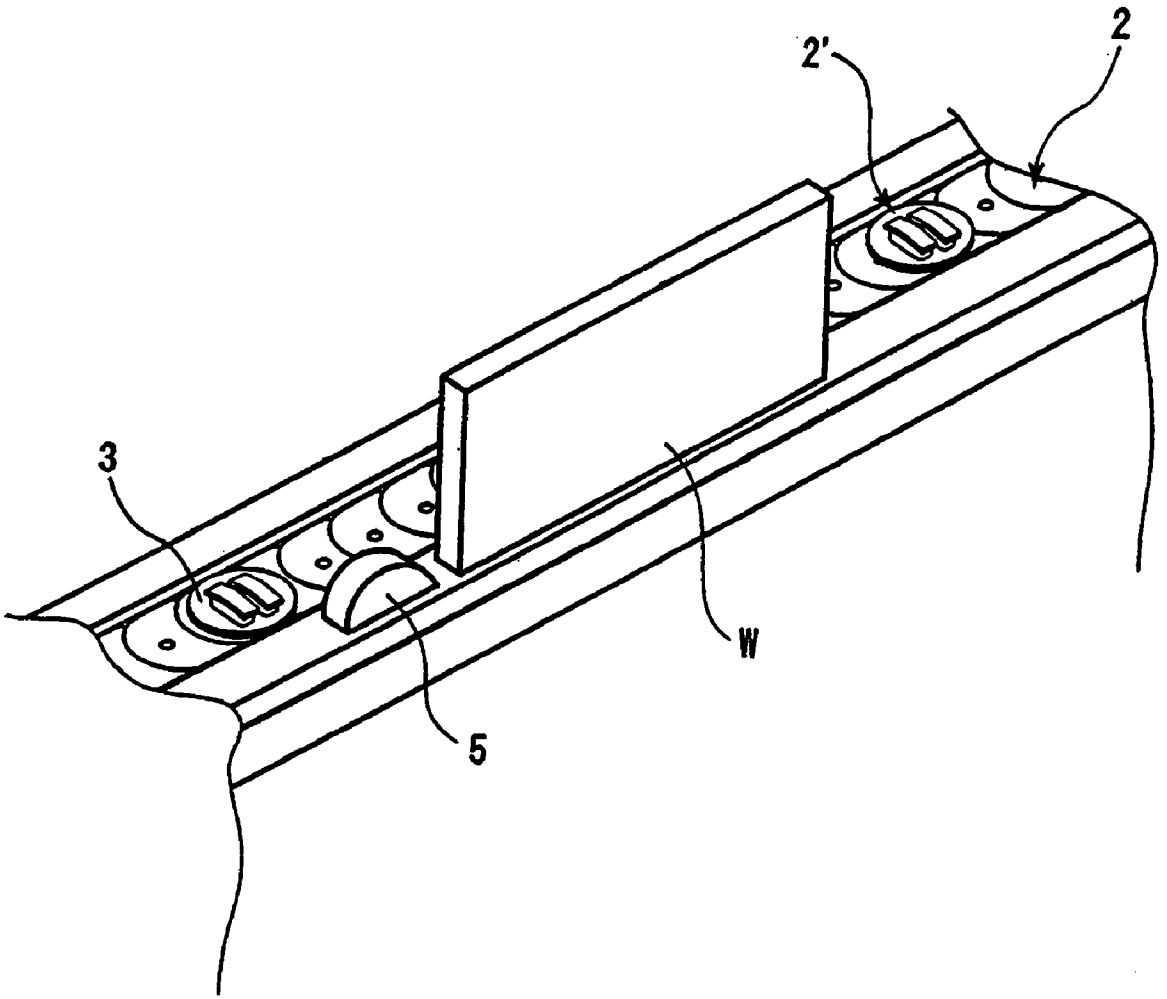
FIG. 2 is a squinting view near the throwing-in area of kitchen side of circulating type carrying path of present invention example.
Figure 3:
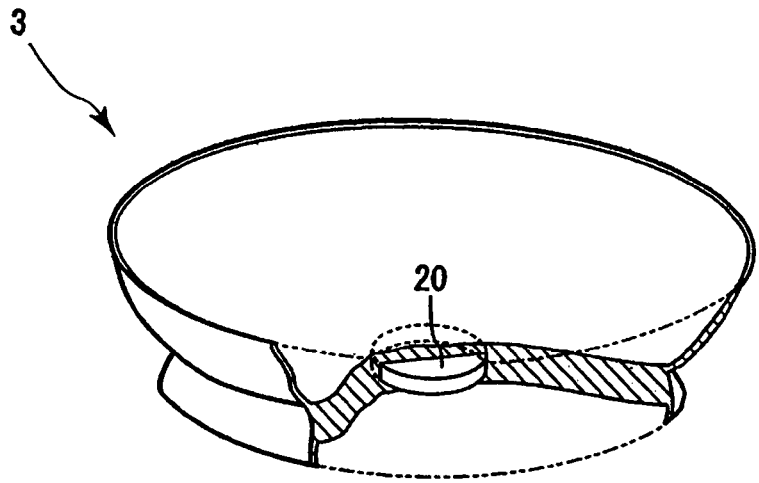
FIG. 3 is a partly fractured squinting overview that shows the Sushi plate that has the ID tag built-in, which is container carrying food and drink used in present invention example.
Figure 4:
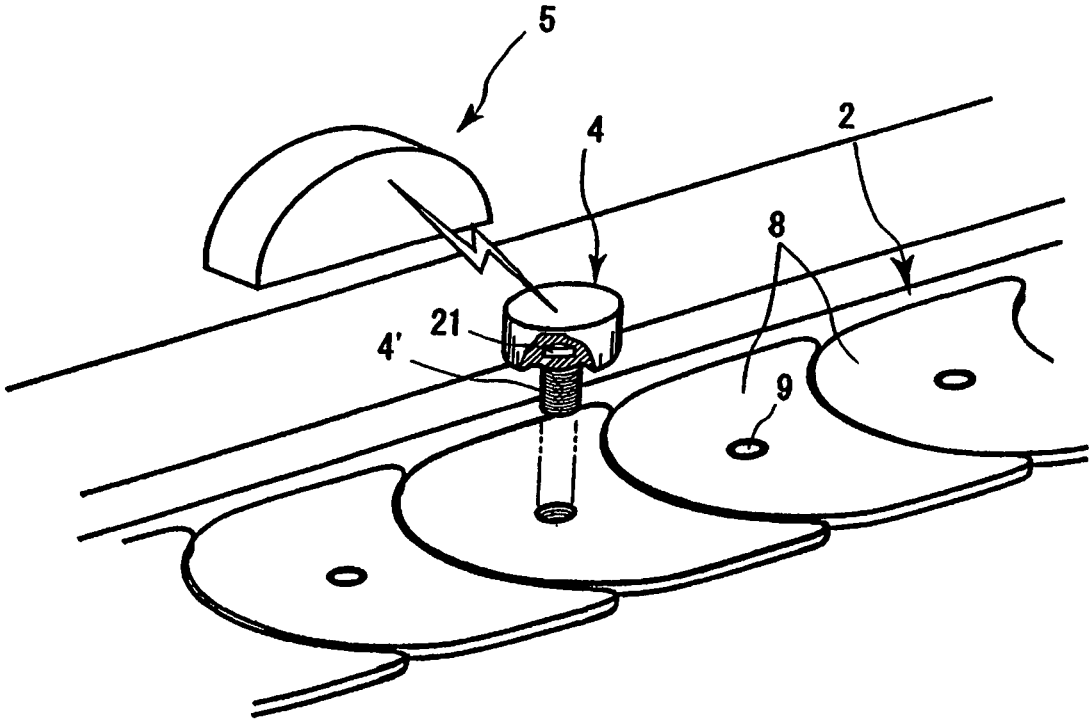
FIG. 4 is a squinting view that shows the fixing condition of sign parts that have the ID tag built-in, to circulation type carrying path used in present invention example.
Figure 5:
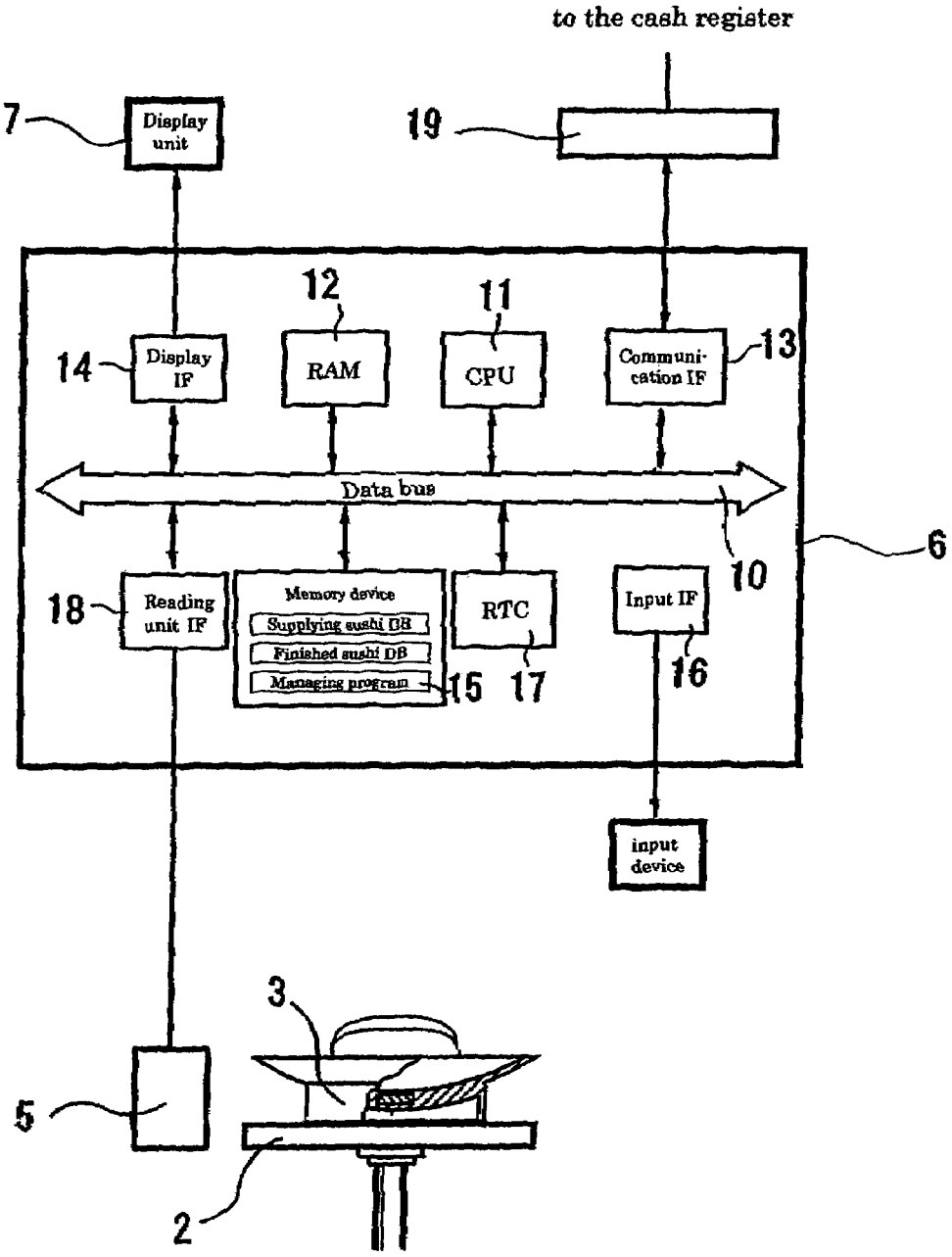
FIG. 5 is a block diagram that shows the structure of food and drink managing device of present invention example.
Figure 6:
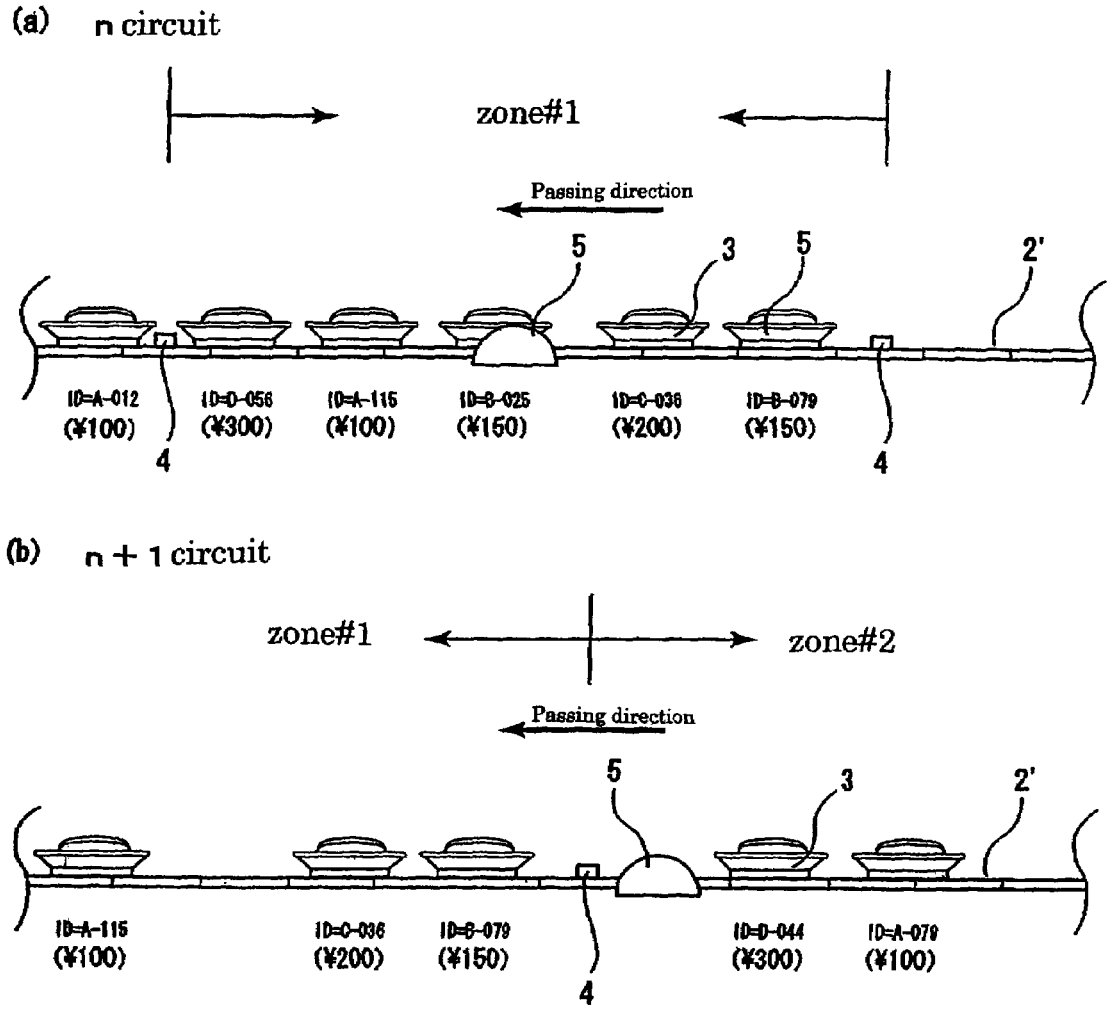
FIGS. 6 (*a*), (*b*) are the explanation drawings to explain the managing condition of food and drink managing device of present invention example.
Figure 8:
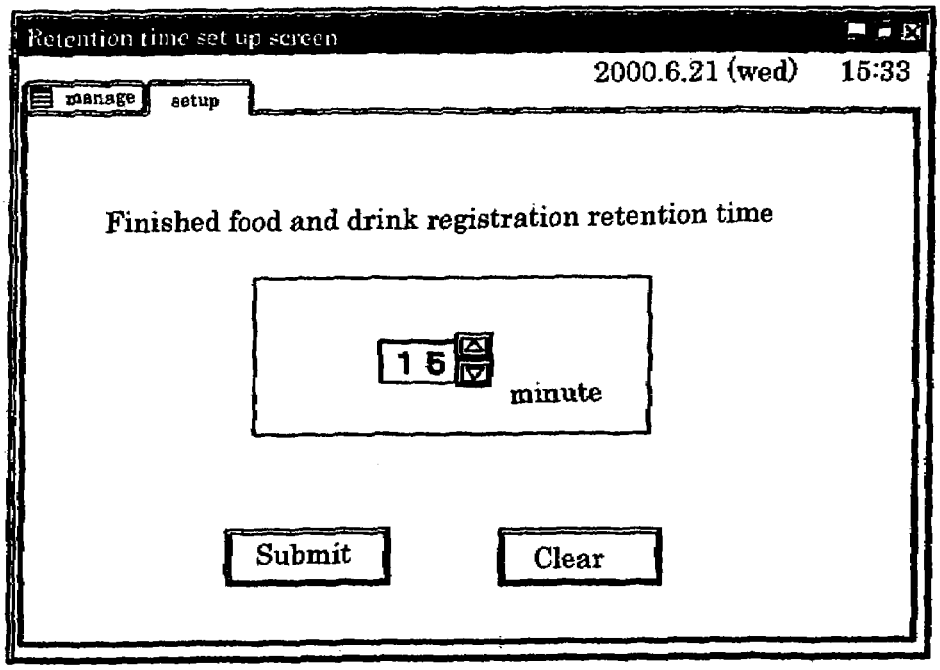
FIG. 8 is a drawing that shows the screen to set the retention time in the managing computer of present invention example.

Following is the explanation of present invention based on drawings. FIG. 1 is a view showing a squinting overview frame format of food and drink managing device with a circulation type carrying path, as present invention example. FIG. 2 is a squinting view near the throwing-in area of kitchen side. FIG. 3 is a partly fractured squinting overview that shows the Sushi plate that has the ID tag built-in, which is container used in present invention example. FIG. 4 is a squinting view that shows the fixing condition of sign parts that has the ID tag built-in, to circulation type carrying path used in present example. FIG. 5 is a block diagram that shows the structure of food and drink managing device of present invention example. FIGS. 6 (*a*) and (*b*) are both the explanation drawings to explain the managing condition of food and drink managing device of present invention example. FIG. 7 (*a*) is a table that shows the organization of Sushi supply data base in food and drink managing device in present invention example, and FIG. 7 (*b*) is a table that shows the organization of consumed Sushi data base in food and drink managing device in present invention example. In addition, FIG. 8 is a drawing that shows the screen to set the retention time in the managing computer of present invention example.

First, food and drink managing device 1 in circulation type carrying path, as present invention example, has external construction shown in FIG. 1. It has flat top chain conveyor 2 which is circulation type carrying path and settled along counter C endlessly. One part of the flat top chain conveyor, which is the right part of dotted line, is kitchen. Each Sushi as food and drink is set on Sushi plate 3 as food and drink container, and each Sushi will be thrown in to said flat top chain conveyor 2 from the throwing-in area 2' which is placed in this kitchen, and conveyed on said flat top chain conveyor 2, and offered to the customer in dining counter C.

In addition, in the downstream side of the conveying direction near throwing-in area 2' settled in said kitchen, and in the near circumference of said flat top chain conveyor 2, as shown in FIG. 3, one reading unit 5 as identification information reading means is placed, which has the ability to read the ID of Sushi plate passing on the flat top chain conveyor by receiving the transmission of ID from ID tag 20 embedded inside Sushi plate 3.

As shown in FIG. 2, this reading unit 5 has prescribed length throwing-in protecting wall W in the upstream side of the circulating path from the position of settled reading unit. The place of the throwing-in protecting wall W forms the food and drink throwing-in prohibited area, and throwing-in can only be done from the upstream side of the throwing-in protecting wall W.

Furthermore, as shown in FIG. 1, this reading unit 5 is connected to managing computer 6 as the registering means that is settled inside the kitchen, and is made to output the read ID of said Sushi plate 3 to said managing computer 6. Mainly, these managing computers 6 and reading unit 5 forms the food and drink managing device of present invention.

Inside the Sushi plate 3 made of resin used in present invention example, as shown in FIG. 3, ID tag 20 that has nonvolatile memory for memorizing specific ID as identical information, and ability to send said memorized ID by electromagnetic wave with prescribed frequency, is buried inside the thick part that is comparatively thick in the bottom of the plate, and by the ID sent from these ID tags each Sushi plate 3 can be identified.

In addition, on these Sushi plates 3, in present invention example, the patterns corresponding to each price (100 yen, 150 yen, 200 yen, 300 yen is used in present example) are printed, and said ID tags 20 of plates with patterns related to each price, are given ID, for example ID starting from "A" such as "A-001, A-002, . . . " in 100 yen patterned plates, ID starting from "B" in 150 yen patterned plates, ID starting from "C" in 200 yen patterned plates, and ID starting from "D" in 300 yen patterned plates. By reading these ID, the price of Sushi plates 3 is able to be judged. And by putting the kind of Sushi of the same price as the price given to said patterned plate on the corresponding patterned plate in said kitchen, and throwing-in the plate of Sushi from said throwing-in area, the price of Sushi plate 3 and the price of each Sushi are made to be identical.

In addition, in flat top chain conveyor 2 of present invention, sign parts 4 which are placed at almost regular prescribed intervals, as shown in FIG. 1 or FIG. 4, are fixated by screw parts 4' in the rotation axis 9 that supports crescent stat 8 shaped as rough semi-lunar with possibility of relative rotation. Inside said sign parts 4, alike the one used in said Sushi plate 3, ID tag 21 which is readable by said reading unit 5 is embedded, and each ID tag 21 is given "P-001~P-005" as ID that shows the "position" which is position of carrying path, and carrying path is divided to 5 zone, #1~#5, by each of these sign parts 4.

In present invention example, in this way, by embedding ID tag 21, which is readable by reading unit 5, inside said sign parts 4 alike said Sushi plate 3, said reading unit 5 is made to be combined with passage detection device in present invention. By this way, there are no need to place these passage detection devices individually, and it is preferable because it will enable to cost down and simplify the device, however, present invention is not limited to this, and for the passage detection device it is also accepted to use the individual device such as transit sensor which detects the said sign parts 4 with light and etc.

In addition, in present invention example, said sign parts 4 is placed on the crescent stat 8 as sticking out. This structure can prevent Sushi plate 3 from being placed on said sign parts 4 and stride across zones, and even if said crescent stat 8 was made of metal, it is preferable because the reading by said reading unit 5 can be done favorably, however, present invention is not limited to this, and it is optional that the sign part 4 is embedded in crescent stat 8 made of resin, and the shape and formation of the sign part 4 can also be optional if said sign part 4 is made to move in conjunction with said flat top chain conveyor 2.

Said reading device 5 that reads ID of the sign part 4 and said Sushi plate 3 is connected to managing computer 6 that is placed inside the kitchen, as shown in FIG. 5, and the structure of managing computer used in present invention example is similar to general computer that includes data bus 10 that sends or receives the data inside computer 6, central processing unit (CPU) 11 that executes various registration processing, RAM 12, real time clock (RTC) 17 that has ability to output the calendar information such as present time data or a day of the week on optional date, input interface (IF) 16 that is connectable to input device such as key board, display interface (IF) 14 that is connected to display device such as display 7, transmission interface 13 that sends and receives the data by being connected to transmission device 19 that conducts the transmission with exterior device such as cash register, reading unit interface (IF) 18 that is connected to said reading unit, memory device 15, formed by magnetic disk or optical magnetic disk, that includes managing program which is describing detail of various conducts carried out by said CPU 11, such as registration conduct or managing conduct, Sushi supply data base (DB) which is registering ID of Sushi plate 3 existing on said flat top chain conveyor, corresponding to each zone that has said Sushi plate 3, with the new detected time of said Sushi plate 3 by said reading device, as shown in FIG. 7 (*a*), and consumed Sushi data base (DB) that is changing and registering the record of Sushi plate 3 which becomes non-detected by said reading unit 5 when customer picks out from flat top chain conveyor 2, as shown in FIG. 7 (*b*).

In what follows, the operation of managing device of present invention example is explained by using FIG. 1, FIG. 6, and FIG. 7. First of all, in the kitchen, Sushi is placed on Sushi plate 3 that has the pattern corresponding to its price and will be thrown-in to flat top chain conveyor 2 from throwing-in area shown in FIG. 1.

Even if Sushi plate 3 in the downstream side runs by said throwing-in, the position of throwing-in is away from reading unit 5 for a given distance, in addition, even if a container is thrown-in in the upstream side of reading unit 5, such throwing-in can not be done by the throwing-in protecting wall W. Reading unit 5 can precisely read each ID of Sushi plate 3.

In addition, the length of this throwing-in protecting wall W is the length that is necessary for a container throwing-in prohibited zone, in other word, it is accepted if it has the length that would not affect the reading of reading unit 5 even if Sushi plate runs at throwing-in moment.

With the passage of Sushi plate 3, the ID of such Sushi plate 3, for example in the circumstance shown in FIG. 6 (*a*), ID "B-025" which is 150 yen Sushi is read by reading unit 5 and said ID "B-025" will be outputted to said managing computer 6.

Based on said output, managing computer 6 will search the existence of read ID "B-025" in Sushi supply data base (DB) and consumed Sushi data base (DB) that are memorized in said memory device 15, in case if each data base (DB) did not have identical ID, as shown in FIG. 7 (*a*), it registers ID "B-025" as Sushi thrown-in newly, in Sushi supply data base (DB), with the zone "#1" in which such Sushi exists, and with the time data.

The thrown-in and conveyed Sushi is offered to customer. When Sushi of said ID "B-025" is consumed (picked out) by customer, in next round, at the moment of detecting ID "P-002" given to the sign parts 4 which is the downstream side of zone "#1", the reading of said ID "B-025" will not be done. Then, managing computer 6 will judge that Sushi of ID "B-025" non-detected in these zone "#1" is consumed, as shown in FIG. 7 (*b*), and will change and register the registered information of said ID in consumed Sushi data base (DB) with time data of that moment.

The data which is changed and registered in the consumed Sushi data base (DB) will be retained and will be erased in turn when the specified retention time passes. For example, in case it takes about 30 minutes to eat generally, wash the Sushi plate 3 after meal, and throw-in said Sushi plate 3 once again to carrying path, in the setup screen shown in FIG. 8, 15 minutes as suitable time which is shorter than said time (30 minutes) will be set. Said data will be retained from the time of aforesaid changing and registering until passing of said set time, and will be erased in turn after 15 minute passes.

By this way, after customer once removed food and drink from carrying path for eating and drinking, and returned them to the different zone of carrying path, said food and drink is once registered to consumed Sushi data base (DB) at the passage of recorded zone in relation to them, however, when said food and drink is detected in other zone, there are identical ID in consumed Sushi data base (DB). Sushi of said ID can be judged as the one returned to carrying path, and by changing the record of said ID to Sushi supply data base (DB) in relation to the re-detected zone, it is possible to prevent the mismatch of data caused by "returning" by the customer.

Above all are the explanations of present invention by using the figures, however, present invention is not limited to these examples, and it is obvious that present invention also involves the changes or addition without departing from the scope of present inventions.

Figure 9:
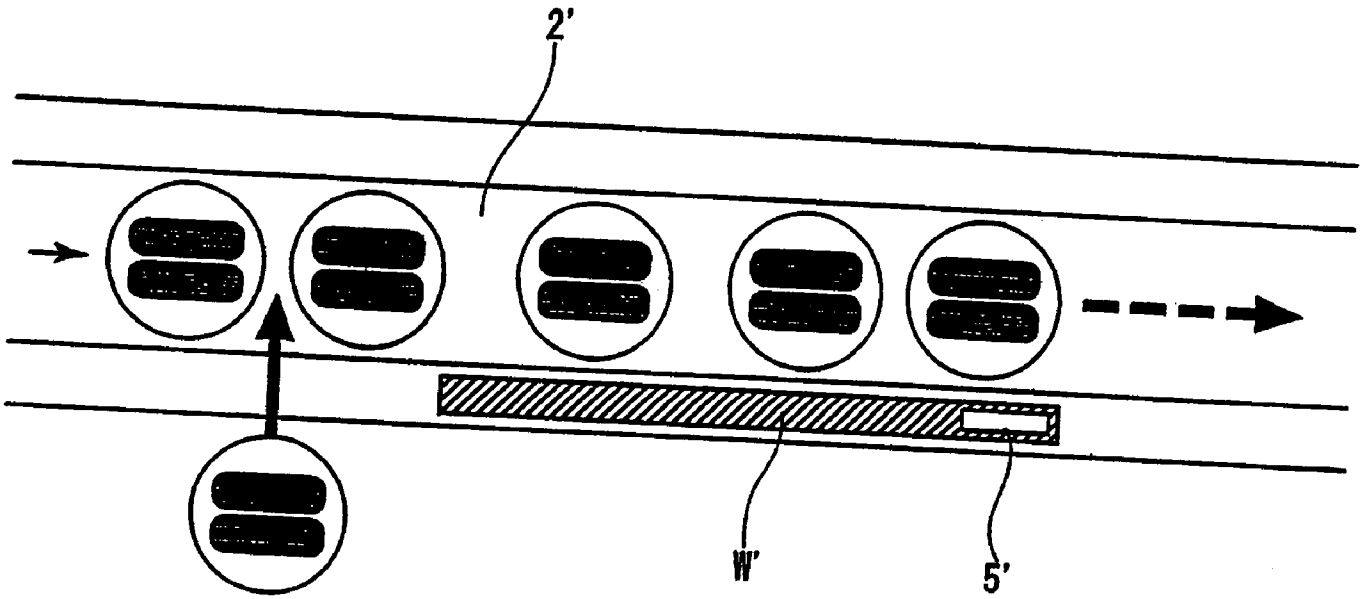
FIG. 9 is the plain diagram view near the throwing-in area that shows another example of throwing-in protecting wall in food and drink managing device of present invention example.

For example, in examples aforesaid, throwing-in protecting wall and reading unit were placed separately, however, as shown in FIG. 9, it is accepted to incorporate the reading unit into throwing-in protecting wall. FIG. 9 is the plain diagram view near the throwing-in area that shows the other alternative practical invention example of throwing-in protecting wall W'. Throwing-in protecting wall W' of a prescribed length is formed in the downstream side of throwing-in area 2', and reading unit 5' is built in to the downstream edge of throwing-in protecting wall W'.

By this way, wherever throwing-in protecting wall W' is placed, because reading unit 5' is protected by throwing-in protecting wall W', reading error will not occur.

Figure 10:
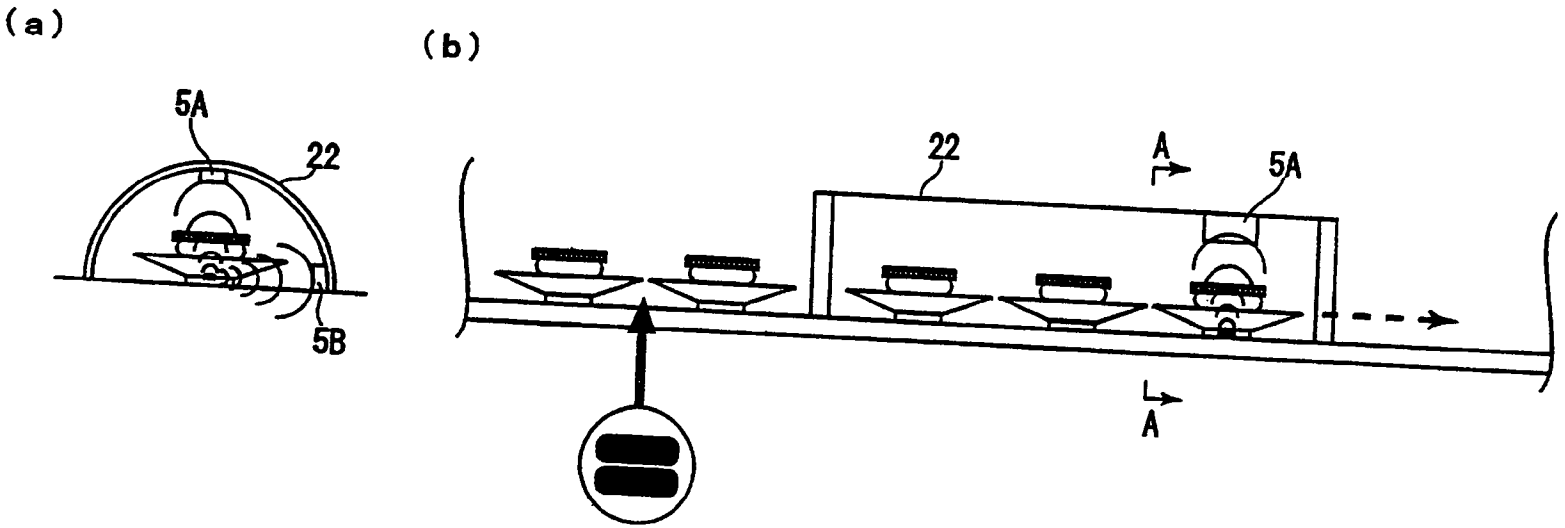
FIG. 10 is the view that shows the placement of the tunnel-shaped-cover in the container throwing-in prohibited area in food and drink managing device of present invention example. (a) is the cross-section diagram A-A of (b). (b) is the side view near the throwing-in area.

Furthermore, FIG. 10 is the view that shows the tunnel-shaped-cover provided to the container throwing-in prohibited area as an alternative of throwing-in protecting wall, (a) is the cross-section diagram A-A of (b), (b) is the side view near the throwing-in area. Reading unit 5A is placed on the upper part of tunnel-shaped-cover 22, reading unit 5B is placed at the side of tunnel-shaped-cover 22, and with them it double-checks the reading of ID. In this way, reading miss will highly decrease. It is accepted to just place whichever of the reading units inside tunnel-shaped-cover 22. It is also possible to prevent the reading error caused by other electromagnetic wave, by giving electric wave shield on the tunnel-shaped-cover 22.

In addition, in example aforesaid, two of reading units 5 are used, but present invention is not limit to this. The number of reading units 5 can be increased within the limits of permitted cost.

In addition, in example aforesaid, said sign parts 4 are placed at almost regular intervals, but present invention is not limit to this.

In addition, in example aforesaid, when the Sushi is consumed by customer and is not detected, the record is changed, but present invention is not limited to this, and as an alternative to this change of record, by erasing the record, it is also accepted to simply manage the Sushi on the carrying path, using aforesaid Sushi supply data base (DB).

Figure 11:
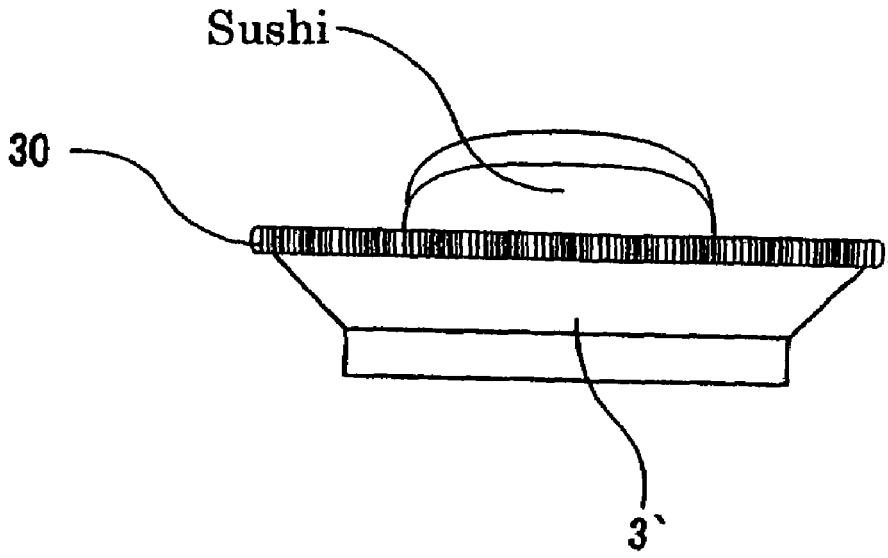
FIG. 11 is the drawing that shows the Sushi plate with bar code for another method of reading the ID without touching.

In addition, in example aforesaid, said ID tags 20, 21 are used in order to read ID data without touching the container. Such thing is preferable because it enables to stably read the ID data without depending on location and direction or dirt of Sushi plate 3, however, present invention is not limited to this, for example of the non-touching reading method, it is also accepted to use bar-code shown in FIG. 11. FIG. 11 is the side view that shows the Sushi plate with bar-code wherein bar-code 30 with registered ID is provided around the edge side of top edge of Sushi plate 3', and it is possible to read the bar-code 30 without touching.

In addition, though it is not done in aforesaid examples, it is optionally accepted to collect the Sushi which has lost it's flavor automatically by taking out the prescribed round conveyed or prescribed time conveyed Sushi after throwing-in, by placing removable instrument connected to said managing computer, such as removing device for removing the Sushi plate 3 on carrying path.

Present invention examples use Sushi as an example of food and drink, however, it is not limited only to Sushi and obviously it can also use other varieties of foods and drinks.

Present invention has following effects.

(a) The present invention reduces the number of said identification information reading means, for example, to one, said registering means will register the identification information of the container in relation to the zone in which the containers exist, and if said sign part in the downstream side of said zone passes and the identification information registered as food and drink being supplied in relation to said zone is not be detected, it can be precisely judged that said supplying food and drink is removed by customer, and not only will it reduce the burden of conduct by simplifying these judging conduct, but also, for example by placing with adding properly the said sign parts, alike the case that a number of the prior identification information means are placed, it enables to get the quality of real-time managing information, and in consequence it will prevent loss of real-time quality of management, without increasing the burden of conduct in managing conduct, and will hold down the cost of whole device. Furthermore, because the container throwing-in prohibited area of a prescribed length is provided in the upstream side of the circulating carrying path from a position of the identification information reading means, in throwing-in moment of container, the containers that are in downstream side from the throwing-in area are not temporarily running or overlapping with another one in the place of identification information reading means, and so, the reading of the identification information will be able to be accurately performed.

(b) According to the invention, the throwing-in protecting wall will prevent the throwing-in even if by mistake one tried to throw-in the container near the place that has identification information reading means.

(c) According to the invention, the throwing-in is prevented by the tunnel-shaped-cover that covers the containers, and identification information can be precisely read by reading means.

(d) According to the invention, there is no need to worry about the disruption of reading of identification information by reading means with the interference of other electric wave.

(e) According to the invention, not only will the maximum of foods and drinks that exist in each zone will be almost identical, but also, because the conveying speed of circulating carrying path is almost constant in general, it is possible to make the transiting interval of said sign parts to be almost identical and, the managing conduct can be operated efficiently.

(f) According to the invention, because sign identification information reading means is combined with the passage detection means, the cost of whole device will be low.

(g) According to the invention, by comparing said time information and present time, the estimated elapsed time of that food and drink on circulating carrying path can be known. For example, management of the freshness of food and drink by using the elapsed time can be operated.

(h) According to the invention, the specified time for holding said registration, for example, is set little shorter than the time until after eating and drinking, containers are collected, washed and used again, 15 minutes as an example. Even in the case when customer removed the food and drink from carrying path and returned the food and drink to the different zone, when identification ID of the container that has food and drink was read again, if the same identification information as one of said removed food and drink exists, it can be judged that the food and drink are returned to the carrying path by customer, and the mismatching of management information by the returning of these food and drink will be prevented.

(i) According to the invention, like aforesaid, the time until after eating and drinking, containers are collected, washed and used again, is generally different in each restaurant, present invention enables to set up those time in accordance with each restaurant.

(j) According to the invention, present invention eliminates the problems during reading such as attrition of food and drink container.

(k) According to the invention, ID reading will be done by wireless means, and stable reading will be conducted without the reading error by the food and drink location, dirt or the like.

(l) According to the invention, present invention enables to manage the price information of foods and drinks supplied on carrying path at the same time.

(m) According to the invention, the error between the actual time of throwing-in and the time registered by the identification information reading means with new detection will lessen.

The invention claimed is:

1. A food and drink managing device with a circulation type-carrying path for providing containers carrying foods and drinks to customers by an endless circulating carrying path, comprising:

an identification information reading means for reading identification information on containers, adapted to identify individual containers, and provided near said circulating carrying path, at least one sign part circularly moving as linked with said circulating carrying path, a passage detection means provided near said circulating carrying path to detect passage of said sign parts, a registering means connected to said identification information reading means and said passage detection means, which recognizes an interval between passing sign parts as one zone, and registers the identification information of the containers read by said identification information reading means, as foods and drinks being supplied in relation to a zone in which the containers exist, and a container throwing-in prohibited area of a given length provided in an upstream side of the circulating carrying path from a position of the identification information reading means, wherein said container throwing-in prohibited area comprises a tunnel-shaped cover that covers the containers, and wherein said identification information reading means is positioned inside said tunnel-shaped cover, and further comprising an electromagnet shield on said tunnel-shaped cover.

2. The food and drink managing device with a circulation type carrying path as claimed in claim 1, wherein said container throwing-in prohibited area comprises a throwing-in protecting wall along said circulating carrying path.

3. The food and drink managing device with a circulation type carrying path as claimed in claim 1, wherein a plurality of said sign parts are positioned at almost regular intervals on said circulating carrying path.

4. The food and drink managing device with a circulation type carrying path as claimed in claim 1, wherein said sign part has sign identification information readable by said identification information reading means, and said identification information reading means is combined with said passage detection means.

5. The food and drink managing device with a circulation type carrying path as claimed in claim 1, wherein said registering means, when detecting new identification information from said identification information reading means, registers the identification information with related time information in that moment.

6. The food and drink managing device with a circulation type carrying path as claimed in claim 1, wherein said registering means, when said sign part in a downstream side of said zone passes said passage detection means, and the identification information registered as food and drink being supplied in relation to the zone is not detected by the identification information reading means, changes a record of identification information to a removed food and drink, and registers time information of said record change in relation to the identification information, and further, holds said registration for a specified time.

7. The food and drink managing device with a circulation type carrying path as claimed in claim 1, wherein said identification information includes price information of foods and drinks.

* * * * *